United States Patent [19]

Yuehui et al.

[11] Patent Number: 4,727,781

[45] Date of Patent: Mar. 1, 1988

[54] SUPERCHARGED POWER TONGS

[75] Inventors: Chen Yuehui; Gao Kun, both of Tien Jing, China

[73] Assignee: The Science & Technic Department of Dagang Petroleum Administration, Tien Jing, China

[21] Appl. No.: 850,717

[22] Filed: Apr. 9, 1986

[30] Foreign Application Priority Data

Apr. 17, 1985 [CN] China ..... 85103021.1

[51] Int. Cl.[4] ..... B25B 13/50

[52] U.S. Cl. ..... 81/57.34; 81/57.19; 91/519; 91/167 R

[58] Field of Search ..... 81/57.34, 57.33, 57.91, 81/57.21, 57.44; 91/519, 167 R

[56] References Cited

U.S. PATENT DOCUMENTS 2,055,815 9/1936 Dewey ..... 91/167

3,500,708 3/1970 Wilson ..... 81/57.34

OTHER PUBLICATIONS

TW-60 Torque Wrench Service Manual; Varco International, Inc., Dec. 1978.

*Primary Examiner*—Frederick R. Schmidt

*Assistant Examiner*—Maurina Rachura

*Attorney, Agent, or Firm*—Christie, Parker & Hale

[57] ABSTRACT

A supercharged power tongs for making up or breaking apart drill tools used in oil or geologic drilling engineering is designed to take the place of B-type tongs. Supercharger and assist fluid cylinders are adopted in the gripping and torqueing devices respectively which are completely new provisions. An automatic make-up torque limitator is built in the control system. A pull-in locating device is used for moving the power tongs. This invention is particularly adequate for make-up and break apart operations on drill pipes, drill collars, kellys and lifting subs when the sizes of these drill tools vary from time to time, with no necessity for replacements of any components.

22 Claims, 19 Drawing Figures off
on
A
B
P
I
II
a
d
e
f
3
8
10
31
32
33
34
35
36
37
38
51
53
54
67
68
69
81
82
84
85
86
88
89
104
105
106
107
108
109
111

7
25
27
29
74
78
79
75
76
77
G1
G'
16
17
18
46
71
72
173
26
300
301
19
28
191
192
1a
70

SUPERCHARGED POWER TONGS

BACKGROUND OF THE INVENTION

Field of the Invention: This invention relates to power tongs for making up or breaking apart the drill tools used in oil and geologic drilling engineering and is particularly adequate for make-up and break-apart operations on drill pipes, drill collars and kellys. The power tongs includes an upper tong and a lower tong each being swivelly connected with the other. Each tong is provided with a pair of hydraulically or pneumatically powered tong dies being capable of moving toward or away from each other synchronously to grip or release drill tools.

Description of the Prior Art: Conventionally, suspended B-type tongs have been used in oil drilling engineering as the equipment for making up or breaking apart drill tools. Their operations concern hazardous and heavy manual labour, and various types of power tongs have then been developed to replace some of the operations of B-type tongs. Among these power tongs, the representative ones are TW-60 model produced by U.S. company Varco and that made known to the public by the U.S. Pat. No. 4,060,014. Their common feature consists in accomplishing the make-up and break-apart tasks with large torques, excluding the function of completing the same mission with small torques unless they are used in combination with a separate spinner having the above-mentioned function. The main disadvantages of existing power tongs are as follows:

1. A hand-operated latching door or similar fittings provided at the mounth of each tong.
2. Operations for replacements of components needed when the sizes of drill tools vary; no automatic adaptability to this variation.
3. More limitation to the eccentric wear of joints of drill tools.
4. More complexity and massiveness.
5. More valves needed when operated and hence less effectiveness presented.
6. A special system for moving the power tongs such as a power hoist or a moving pedestal needed.

SUMMARY OF THE INVENTION

An object of the present invention is to provide suspended power tongs including upper and lower tongs each having a pair of gripping devices. The way said upper and lower tongs connect with each other enables them to swivel relatively clockwise or counterclockwise from their coincident positions around a fixed axis (the axis of drill tools) over a certain angle under the guide of a guiding device to complete the movements for making up or breaking apart joints of drill tools.

Another object of the present invention is to provide supercharged gripping devices mounted on both upper and lower tongs to offer large forces so as to grip joints of drill tools sufficiently and thus to ensure reliable transmission of the large torques exerted when making up or breaking apart. The supercharged gripping devices can even automatically adapt the variation of the size of the drill tools gripped and accurately grip drill tools without adjustment when the size of drill tools being changed. The gripping or releasing action of two opposite movable tong dies can be realized synchronously by means of a synchronizing machanism.

Another object of the present invention is to provide a combinatory torque-generating unit enabling upper and lower tongs to swivel relatively and offering normal makeup or break-apart torques with larger ones at the beginning of break-apart operation.

Still another object of the present invention is to provide a compact pull-in locating device used to haul power tongs to grip drill tools accurately.

A further object of the present invention is to provide a control system consisting of hydraulically powered units and pipings to enable power tongs to be operated according to predetermined procedures.

A still further object of the present invention is to provide locking devices in both upper and lower tongs to enable them to be operated individually or jointly.

The last object of the present invention is to provide adjustable devices making tong dies have certain flexibility to have tong bodies evenly pressured and adapt automatically the irregular joints of drill tools caused by eccentric wear.

DETAILED DESCRIPTION OF THE PREFERRED EMBODIMENT

Figure 1A:
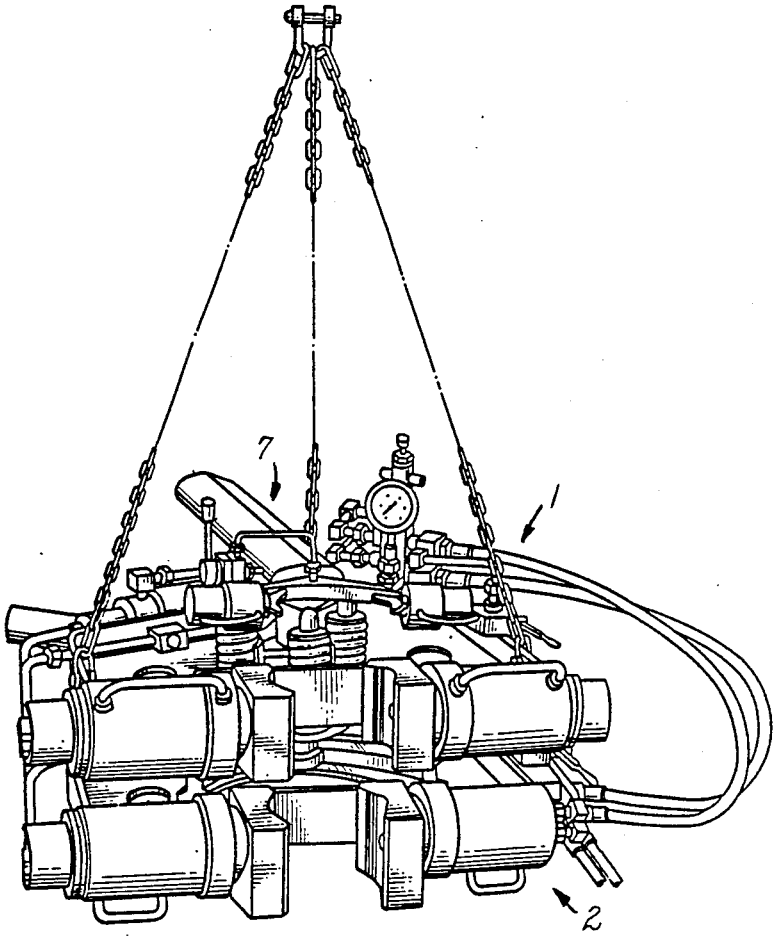
FIG. 1*a* is a perspective view of the power tongs of the present invention.
Figure 1B:
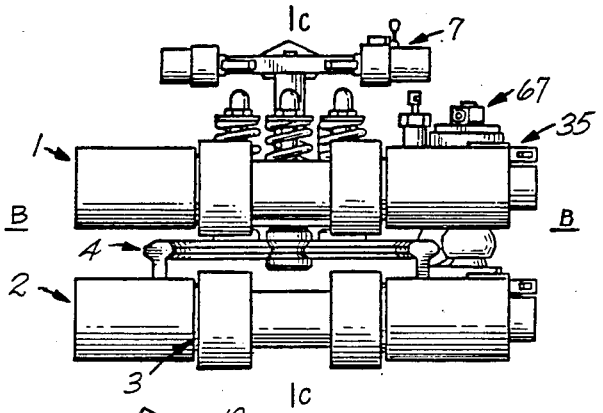
FIG. 1*b* is an elevational view of the power tongs of the present invention.
Figure 1C:
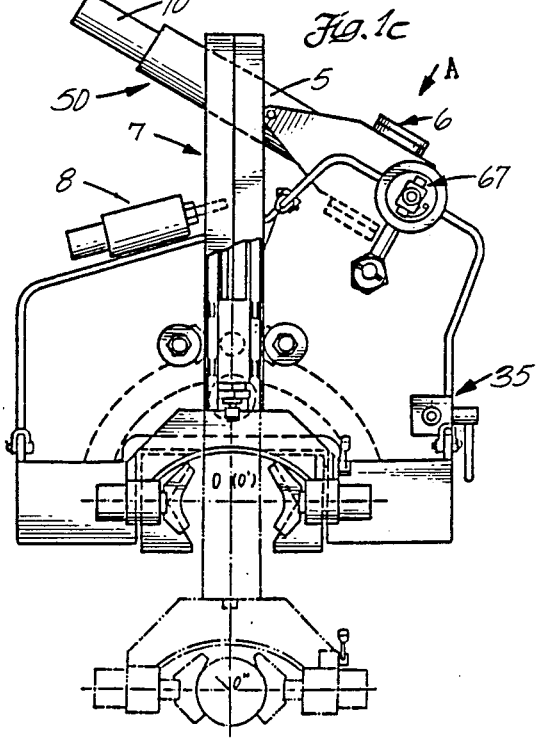
FIG. 1*c* is a top plan view of the present invention.

FIG. 1 is a schematic view of a preferred embodiment of the supercharged power tongs of the present invention. The power tongs are suspended near the well head. An upper tong (1) and a lower tong (2), both with substantially identical configuration are swivelly connected by a roller ram suspension device (4) funtioning as a linking and guiding attachment. Provided at the front of each tong is a pair of relatively extendable and retractable tong dies (33) directly powered by a pair of gripping fluid cylinders. Even mounted on each tong is a supercharger fluid cylinder (8) with the function to distribute the pressurized fluid coming from the hydraulic source to two gripping fluid cylinders and, when necessary (after gripping jaws have gripped joints of drill tools), supercharge the fluid in the gripping fluid cylinders thus increasing the gripping forces on joints of drill tools and isolating the passage between two gripping fluid cylinders of the same tong. At the end of the power tongs is a combinatory torque-generating unit (50) enabling upper and lower tongs to swivel relatively and offering torques for make-up or break-apart. The piston extension of torqueing fluid cylinder (5) is pivotally mounted on the end of lower tong (2) and the cylinder itself pivotally connected with the end of upper tong (1) through a suspension device (6). Thus, when fluid cylinder (5) is filled with pressurized fluid, its movement causes upper and lower tongs to swivel relatively in a direction to complete make-up operation. When upper and lower tongs are at initial aligned position, fluid cylinder (5) can be turned 180 degrees horizontally. Thus, when pressurized fluid enters fluid cylinder (5) again, upper and lower tongs will swivel relatively in another direction to complete break-apart operation. At the beginning of break-apart operation, assist fluid cylinder (10), mounted at the end of torqueing fluid cylinder(5), may offer extra push to increase the break-apart torques. Mounted above the upper tong is a compressed-air powered pull-in locating device comprising mainly an air cylinder with its piston extension being provided with a pneumatically powered gripping head. When operating, workers may drag over the pull-in locating device manually and align it with the drill tools to be gripped and then switch in the air supply to grip the drill tools—at this moment the air enters the hauling air cylinder to have the suspended power tongs peneumatically dragged to the drill tools for engaging in make-up or break-apart operation. The whole power tongs are connected to a separate hydraulic source provided with a control system through pressureresistant hoses.

Figure 3:
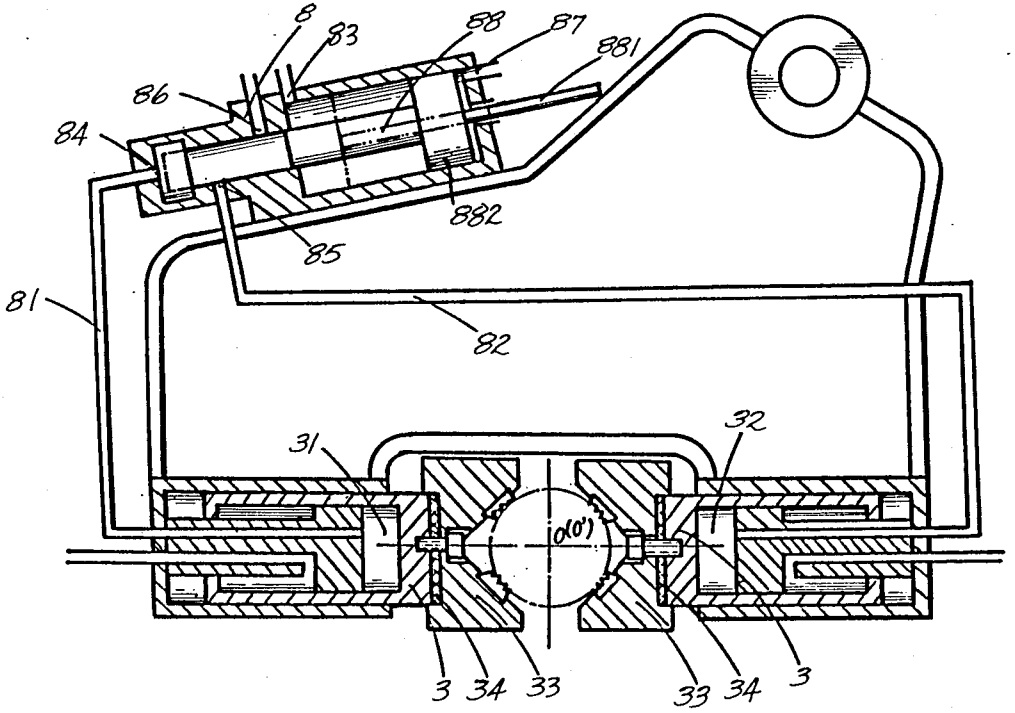
FIG. 3 is a schematic view of the layout of the supercharged gripping device.

The supecharged gripping device shown in FIG. 3 includes a pair of gripping fluid cylinders (3) mounted on tong body (1*a*, 2*a*) and working synchronously and a supercharger fluids cylinder supercharging the fluid circuit of the gripping fluid cylinders. The supercharged gripping devices used for upper and lower tongs are identical, with the following two remarkable features: firstly, gripping any joints of drill tools within a specified range (for example 3 inch to 8 inch) without the need for replacements of any components so avoiding the trouble, often encountered in field service, of replacing components for gripping devices and being time-saving when gripping cross-over subs; secondly, applying supercharging technique to the local fluid circuit of gripping fluid cylinders (3) with high pressure up to, for example, 1000 bars or more to achieve required gripping forces—this plays an important part in making the whole power tongs compact.

To transmit large torques required for make-up operation, or more especially for break-apart operation (for example, 10000 kg .fm), large gripping force needs to be put out by the gripping fluid cylinders. If conventional design were adopted, large diameters of the gripping fluid cylinders would be needed thus greatly increasing the volume and weight of the gripping fluid cylinders (3) and that of the power tongs on the whole. The supercharger fluid cylinder (8) described in the present invention supercharges the fluid circuit of gripping fluid cylinders (3) to grip the joints sufficiently after cylinders (3) grip joints of drill tools beforehand under the action of the pressurized fluid from the fluid pump. Supercharger fluid cylinder (8) of the supercharged gripping device adopts the supercharging arrangement of plunger-pair type. In the supercharger fluid cylinder is a plunger chamber (106) with smaller diameter and a coaxial piston chamber with larger diameter. These fluid openings (84, 85, 86) are located at the front, near the middle and at the end (near the piston chamber) of the plunger chamber respectively. The movable piston assembly in the supercharger cylinder is a component shaped like a stepped shaft with a plunger (88) at one end fitting fluid-tightly against the plunger chamber, a piston (882) in the middle fitting fluid-tightly against the piston chamber and small diameter stroke-displaying rod (881) at the other end. The displaying rod keeps projecting from the small packed hole at the back of the cylinder.

The fluid flow enters working chambers (31) and (32) of the gripping fluid cylinders through fluid openings (86) and (84) (85) under the system pressure, before the supercharger fluid cylinder actuates, to have the gripping fluid cylinders (3) extended out to complete the prgripping of joints of drill tools. Then, by switching master control vlave (37) (the switching principle will be described in detail in another part relating to the fluid circuit), the pressurized fluid flow of the system comes through fluid opening (87) and supercharging plunger (88) starts moving forward closing fluid opening (86) to supercharge working chambers (31) and (32) of the gripping fluid cylinders. When supercharging plunger (88) moving forward further, the working chambers (31) and (32) of the gripping fluid cylinders are isolated to avoid the floating of the two gripping fluid cylinders. Supercharging plunger (88) moves forward and the supercharging process continues until achieving the balance of the supercharging forces, for example, arriving at the position shown by the dash-and-double-dot line. Supercharger fluid cylidner (8) can be mounted on the side plated of tong body (1*a*, 2*a*) or other suitable place.

Figure 4:
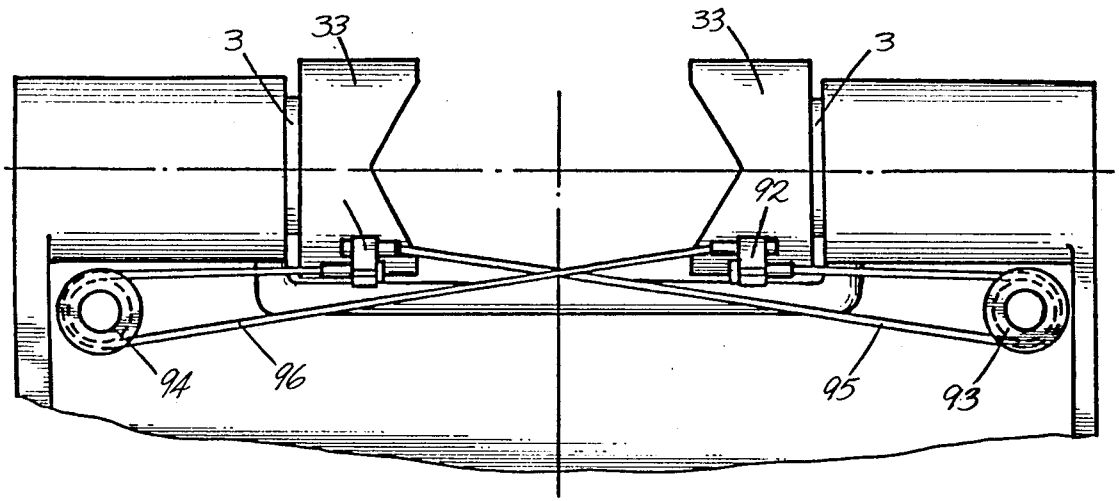
FIG. 4 is a schematic view of the synchronizing machanism of gripping fluid cylinder.

FIG. 4 illustrates the synchronizing mechanism. Two gripping fluid cylinders (3) of each tong, when extending or retracting, may lost synchronism for reasons of different resistance and so forth. The synchronizing mechanism of the present invention consists of wire rope and pulleys. The machanism consists of a pair of synchronizing pulleys (93) and (94) mounted on the bottom face of tong body (1*a*, 2*a*), a pair of fixing blocks (91) and (92) attached to the tong dies (33) and two lengths of synchronizing wire rope (95) and (96). When gripping fluid cylinders (3) wholly retracted, synchronizing wire ropes (95) and (96) can be set in the way that one end of synchronizing wire rope (95) is attached to fixing block (92) on the right tong dies and the other end is around clockwise right synchronizing pulley (93) to come to fixing block (91) on the left tong dies and fixed there with proper tension; and one end of the other synchronizing wire rope is attached to fixing block (91) on the left tong die and the other end is around counterclockwise left synchronizing pulley (94) to come to fixing block (92) on the right tong die and fixed there with the same proper tension. Therefore, whatever either of two gripping fluid cylinders (3) extends out first, the opposite one of two gripping fluid cylinders (3) will surely be pulled over through synchronizing wire ropes (95) and (96); on the other hand, whenever either retracts first, the opposite one will be pulled back. Thus, the air of forced synchronism is obtained.

Figure 2:
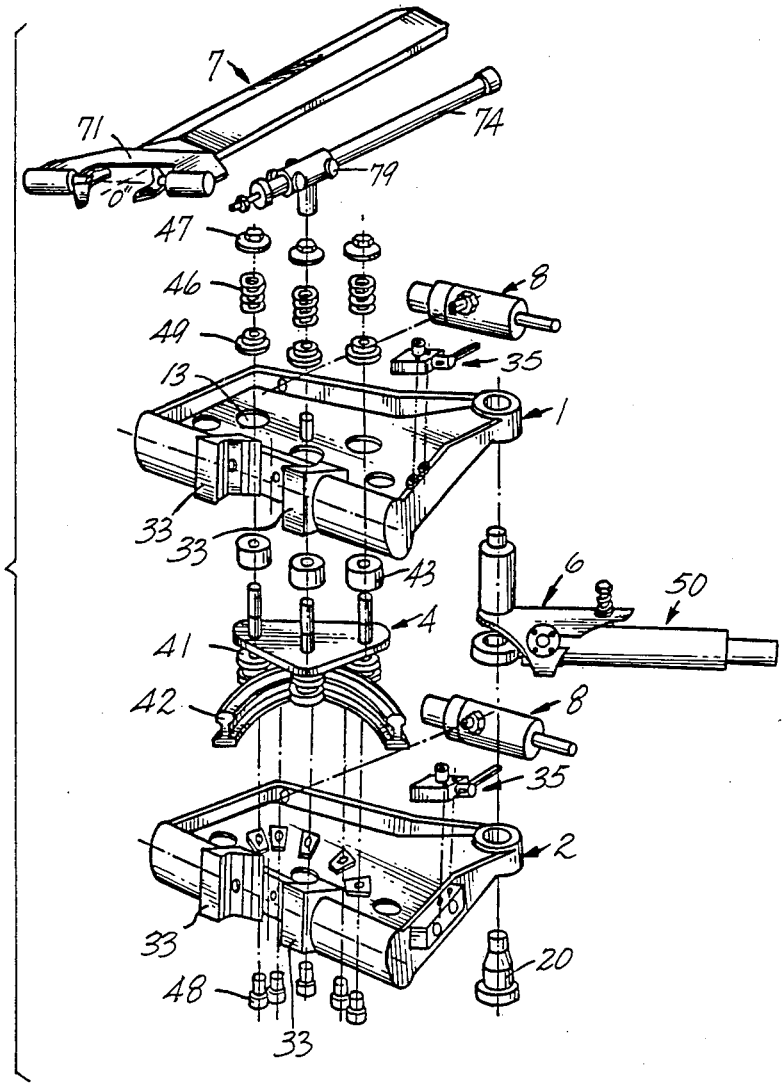
FIG. 2 is an exploded perspective view of the main components of the present invention.
Figure 9B:
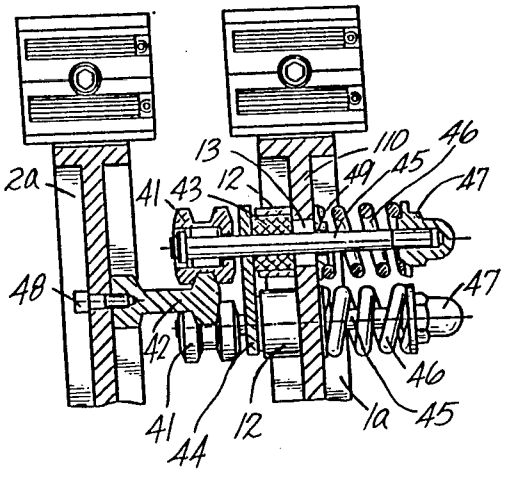
FIG. 9*b* is a section view along the line C—C in FIG. 14 (not shown the pull-in locating device)
Figure 9A:
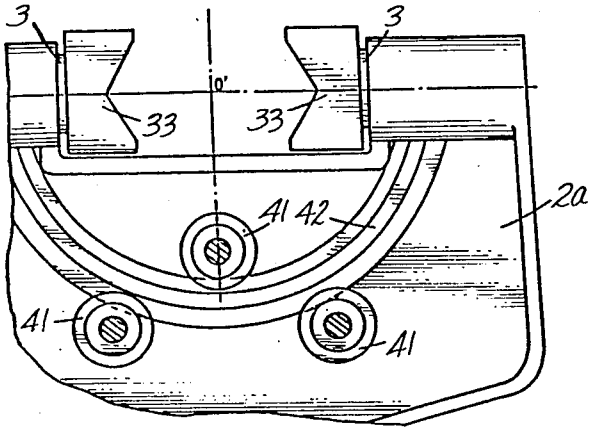
FIG. 9*a* is a schematic view of the mounting of the roller ram suspension device on the lower tong body along line B—B in FIG. 1*a;*

Referring to FIG. 2 and 9, we now describe the roller ram suspension device connecting upper and lower tongs. To keep the tong mouth centres of upper and lower tongs (1) and (2) steadily on a vertical axis and make upper and lower tongs (1) and (2) swivel relatively about the connecting line of tong mouth centres (0, 0') as an axis (see FIG. 2), used in the present invention is a roller ram suspension device (4) for connecting upper and lower tongs (1) and (2). The semicircular ram is fastened on lower tong (2) by bolts (48) and its circle centre is coincident with tong mouth centre (0') of the lower tong Three rollers (41), with centreing effect, are united by a roller supporter (44) and roll on semicircular ram (42) around tong mouth centre (0') of the lower tong. Three buffering rubber rings (43) jacketing each of three roller axles (45) are respectively set in three locating recesses (12) under web (110) of the upper tong body. Three roller axles (45) pass through three holes (13) in upper tong body (1a), and washers (49) and springs (46) are put on these axles before they are screwed up with check nuts (47). The three holes in upper tong body (1a) are coaxial with three locating recesess (12) under web (110) of upper tong body (1a). The diameters of three holes (13) are larger than those of roller axles (45) passing through the holes and smaller than those of three locating recesses (12). The positioning of three locating recesses (12) should ensure that tong mouth centre (0) of upper tong (1) and tong mouth centre (0') of lower tong (2) are on the same verticle centre line after upper and lower tongs (1) and (2) are assembled together. And the centre line of the axle hole at tong end (11) of the upper tong body is aligned with the centre line of the upright rod hole at tong end (21) of the lower tong body. Thus, when the tong mouths of power tongs are unloaded, upper and lower tongs (1) and (2) can swivel relatively around the axis of one and the same hypothetical drill tool by means of roller ram suspension device (4). When the tong mouths are loaded with drill tools for normal make-up or break-apart operations, upper and lower tongs (1) and (2) can swivel around the axis of the drill tools. In ideal situation, there should be no lateral pressure on roller ram suspension device (4). When making up or breaking apart eccentrically worn drill tools, the uncoaxiality of the tong mouths of upper and lower tongs, caused by gripping the eccentrically worn joints with power tongs, can be compensated by the compressive deformation of three buffering rubber rings (43).

Self-adjustable arrangement is provided for each gripping device (see FIG. 3). Set between gripping fluid cylinders (3) and tong dies (33) are rubber cushions (34) not only to even the forces on the tong bodies and shield the tong dies, but also to make tong dies (33) engage in adaptive self-adjustment thus assuring the even and secure gripping of joints of drill tools when gripping the irregular joints caused by eccentric wear and so forth.

Figure 5:
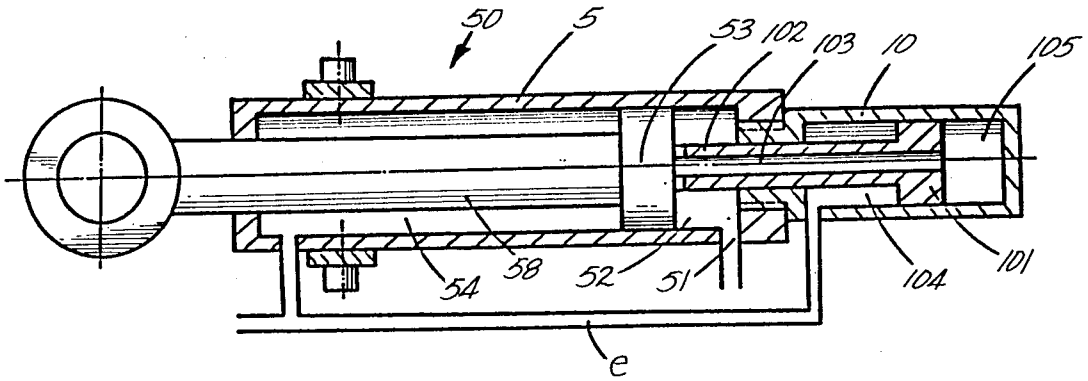
FIG. 5 is a horizontal section view of the torqueing fluid cylinder.

All the joints of drill tools used in drilling engineering are with taper-threaded connections and sealed by shoulder faces thus making the torques required for breaking appart joints of drill tools maximal. And the break-apart torques required, after joints having been broken apart a certain angle, will reduce sharply: The present invention provides a compact combinatory torque-generating unit to adapt itself to above-mentioned situation. FIG. 5 illustrates that the combinatory torque-generating unit includes a torqueing fluid cylinder (5) and an assist fluid cylinder (10) and that how the fluid circuit is connected The fluid flow simultaneously enters working chamber (52) of torqueing fluid cylinder (5) through fluid opening (51) and working chamber (105) of assist fluid cylinder (10) through hollow passage (103) in piston rod (102) of assist fluid cylinder (10). Therefore, within the range of the working stroke of the assist fluid cylinder, when piston rod (102) of the assist fluid cylinder is against piston piston (53) of torqueing fluid cylinder (5), the push put out by the torqueing fluid cylinder will be the maximum being equal to the sum of the pushes from assist fluid cylinder (10) and torqueing fluid cylinder (5). In addition, because restoring chamber (104) of assist fluid cylinder (10) and restoring chamber (54) of torqueing fluid cylinder (5) are connected by passage (55), both the working and restoring operations are conducted automatically without the necessity of any valves or other special operation. The present power tongs have rotation angle of 45 degrees for make-up or break-apart operations and the stroke of assist fluid cylinder (10), when breaking apart, corresponds the working rotation angle of about 15 degrees. Torqueing fluid cylinder (5) provides torques for normal make-up or break-apart operations while assist fluid cylinder (10) puts out certain torques only during breaking apart to fulfill the requirement of breaking apart with large torques.

Figure 6B:
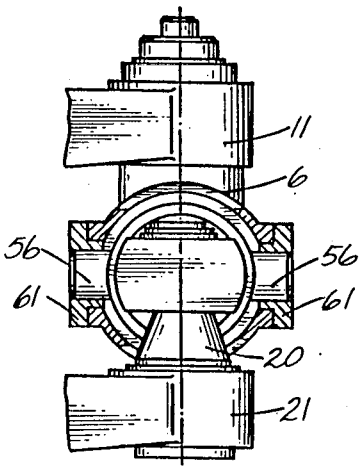
FIG. 6*b* is a section view along line D—D in FIG. 6*a;*
Figure 6A:
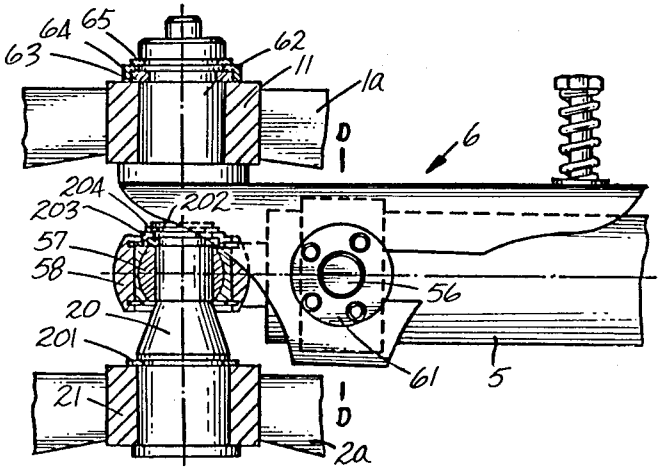
FIG. 6*a* is a schematic view of the torqueing cylinder suspension device from the direction indicated by arrow A in FIG. 1*b;*
Figure 7:
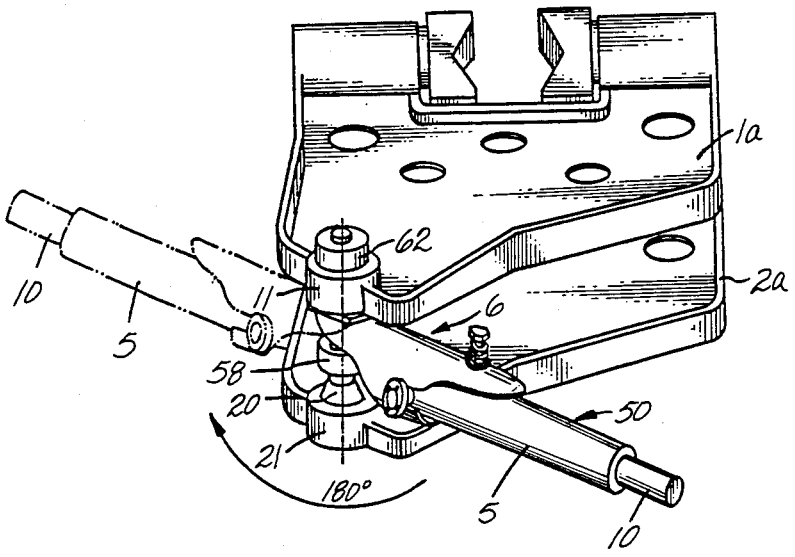
FIG. 7 is a schematic view of the reversion of the torqueing cylinder.
Figure 8:
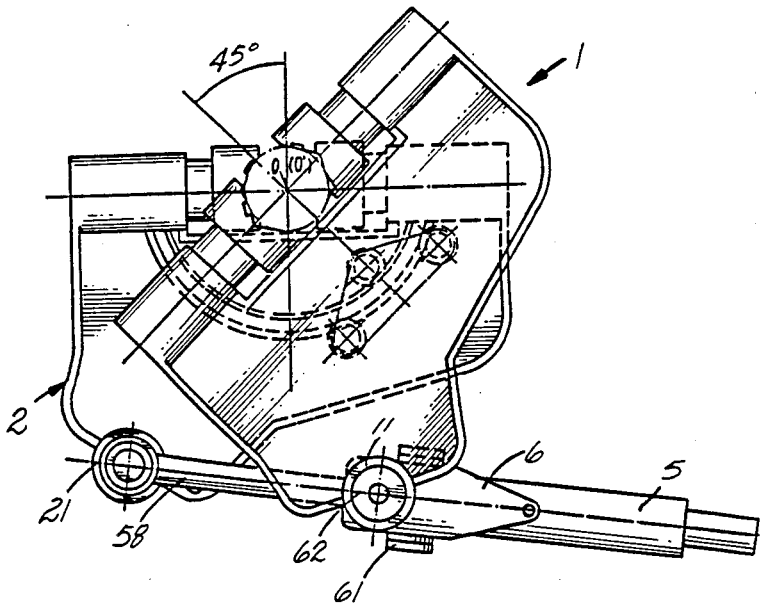
FIG. 8 is schematic view of the upper and lower tongs swivelling relatively.

The present power tongs provide a reversing device for altering action direction of torqueing fluid cylinder (5) to easily realize switching over make-up or break-apart procedures and facilitate operators' manipulation. FIG. 6 illustrates a reversable suspension device (6) of torqueing fluid cylinder (5) which being mounted at the end of power tongs. When the torqueing fluid cylinder wholly retracted, upright axle (62) in the axle hole at tong end (11) of upper tong body (1*a*), upright rod (20) in the upright rod hole at tong end (21) of lower tong (2) and ball bearing (57) on the piston of torqueing fluid cylinder (5) which being jacketed on the journal of upright rod (20) are coaxial vertically. Thus, torqueing fluid cylinder (5) may freely rotate 180 degrees as shown in FIG. 7. Mounted symmetrically on both sides of torqueing fluid cylinder (5) is a pair of lug pivots (56) with lug flanges (61) then being attached to the suspension device (6), thus torqueing fluid cylinder (5) may swivel to certain extent in a vertical plane around the axis of lug pivots (56). Upright axle (62) of suspension device (6) is pivotally erected in the axle hole at tong end (11) of upper tong body (1a) and held by locking key (64), key cap (63) and elastic retainer (65); ball bearing (57) on the piston (58) is jacketed on the journal at the upper end of upright rod (20) and held by the locking key (203), key cap (202) and elastic retainer (204); and the lower end of upright rod (20) is put in the axle hole at tong end (21) of lower tong body (2*a*) and held by elastic retainer (201). Because of the coaxility of the above arrangement, torqueing fluid cylinder (5), in its restored state, may easily turn 180 degrees horizontally and reverse the directions of the torques put out from torqueing fluid cylinder (5). Torqueing fluid cylinder (5) and suspension device (6) are connected together through lug pivots (56) horizontally arranged on torqueing fluid cylinder (5). When extending out, piston rod (58) of the torqueing fluid cylinder may cause upper and lower tongs (1) and (2) to swivel relatively around the axis of drill tools to achieve the purpose of making up or breaking apart. FIG. 7 and FIG. 8 illustrate the break-apart state. As shown in FIG. 7, if torqueing fluid cylinder (5) is turned to the dash-and-double-dot position along the arc arrow, the making-up operation can also be done according to the same working principle above-mentioned, but with upper and lower tongs swivelling in the direction opposite to that of the breakapart operation.

Figure 13:
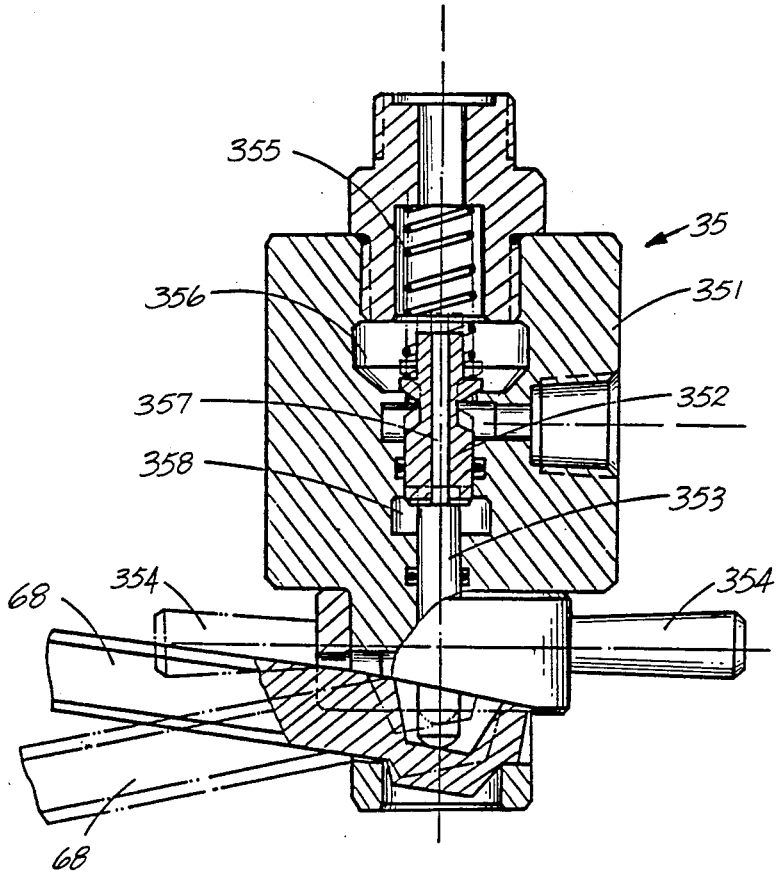
FIG. 13 is a schematic view of the configuration of the hand-operated hydraulic lock.

A hand-operated hydraulic lock, as shown in FIG. 13, is provided with each of the fluid circuits of gripping fluid cylinders (3) of upper and lower tongs. The hydraulic lock can be preset for its engagement or release whereby upper and lower tongs can realize optional separate operations. As shown in FIG. 13, the hand-operated hydraulic lock consists mainly of valve body (351), valve poppet (352), push rod (353), release handle (354), spring (355) and operating handle (68). Balance hole (357) in valve poppet (352) balances the hydraulic pressure of chamber (356) against that of chamber (358) to have the compressing force partially balanced, which exerts on valve poppet 352 when the hydraulic lock locks up, thus saving the effort during hand release operation. FIG. 13 illustrates the engagement state of the hydraulic lock, and the position shown in the figure by the dash-and-double-dot lines gives the release state preset by the hydraulic lock.

Figure 10:
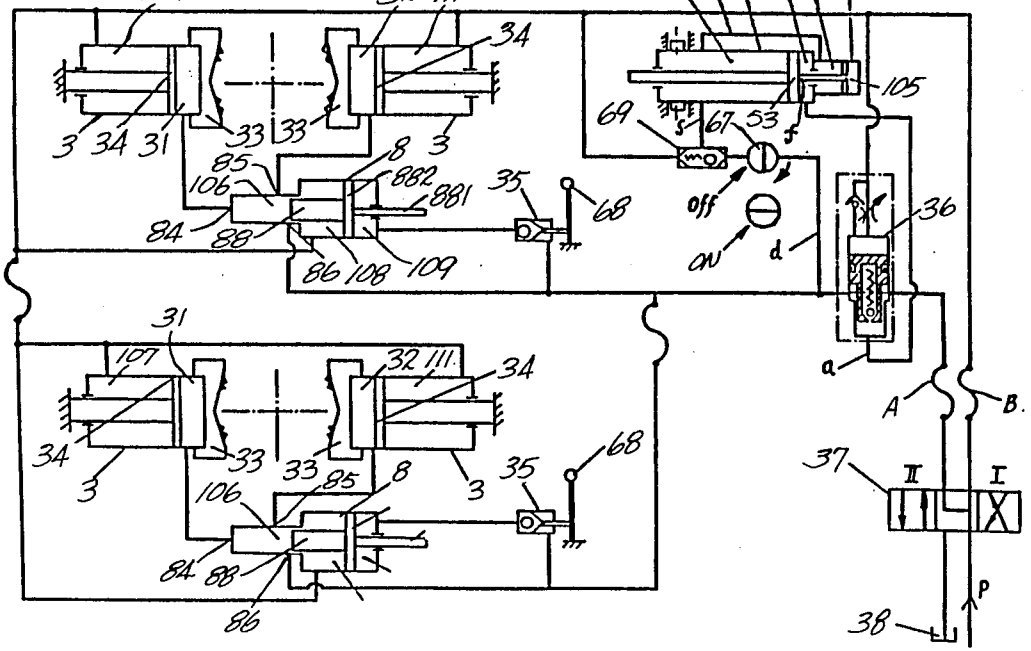
FIG. 10 is a schematic fluid circuit for the power tongs.

FIG. 10 gives the scheme of the fluid circuit of the power tongs. By taking the break-apart operation as an example, the relationship between the fluid circulation and the movements of the power tongs are explained as follows (the restored position of the power tongs is taken as the reference state):

The pressurized fluid from hydraulic pump (p) flows into master control valve (37) which can be mounted directly on a tong body or other place desired. The master control valve is a Y-type three-position-four-way valve. When the valve spool is at its intermediate position, the pressurized fluid simultaneously flows into two high pressure hoses (A) and (B) communicated to the power tongs. At this moment, time-delay valve (36) is closed—time-delay valve (36) is of the feature that when the pressurized fluid is supplied dually by hoses (A) and (B) or singly by hose (B), the valve will stay at its close position. As can be seen from FIG. 10, when the pressurized fluid is supplied dually by hoses (A) and (B), there is no output from outlet (a) of the time-delay valve (36) so that no pressurized fluid enters working chamber (51) of torqueing fluid cylinder (5) and restoring chamber (54) of torqueing fluid cylinder (5) is communicated with pipe (B). So torqueing fluid cylinder (5) continues to stay at the restored state. By opening hand-operated hydraulic lock (35), chamber (106), chamber (109) and restoring chamber (108) of supercharger fluid cylinder (8) are filled with pressurized fluid and the pressures in all the chambers are the same. Therefore, the restoring force acting on the left side of piston (882) of supercharger fluid cylinder (8) is larger than the force pushing piston (882) leftward in working chamber (109). This holds securely the supercharging plunger at the restored position, also keeps holse (A) being fluid communicated with working chambers (31) and (32) of gripping fluid cylinders (3) and makes each gripping fluid cylinder in the state of differential connection.

Under the condition of supplying pressurized fluid through dual hoses (A) and (B), the pressures in working chambers (31), (32) and the restoring chambers (107) and (111) of gripping fluid cylinders (3) are identical. But since the effective piston areas in the working and restoring chambers are different and the gripping fluid cylinders are in the state of differential connection, the gripping fluid cylinders can be extended out speedily to push tong dies (33) forward to complete pre-grippig movements.

When the pressure signal (not shown) given out after the pre-gripping operation of the gripping fluid cylinders causes master control valve (37) to switch automatically to position I whereby hose (A) still supplies pressurized fluid and hose (B) connects to the tank, following variations will occur:

When hose (B) communicates with tank (38), the fluid pressure in restoring chamber (108) of supercharger fluid cylinder (8) falls. And the pressurized fluid from hose (A) continues to enter working chamber (109) through hand hydraulic lock (35). The supercharging plunger becomes unbalanced and moves foreward to supercharge supercharging chamber (106) and working chambers (31) and (32) of gripping fluid cylinders (3). As can be seen from FIG. 10, during supercharging, plunger (88) first closes fluid opening (86) communicating fluid from hope (A) with supercharging chamber (106) and next closes fluid opening (85) communicating to working chamber (32) of the gripping cylinder on the right-hand side until the supercharging force gets balanced. Experiments have shown that it necessitates only 0.1–0.2 second to achieve the supercharged gripping. The regulation of the open time of time-delay valve (36) must match the time required for the supercharged gripping. This can be realized by making adjustment through the throttling portion in time-delay valve (36).

Figure 11A:
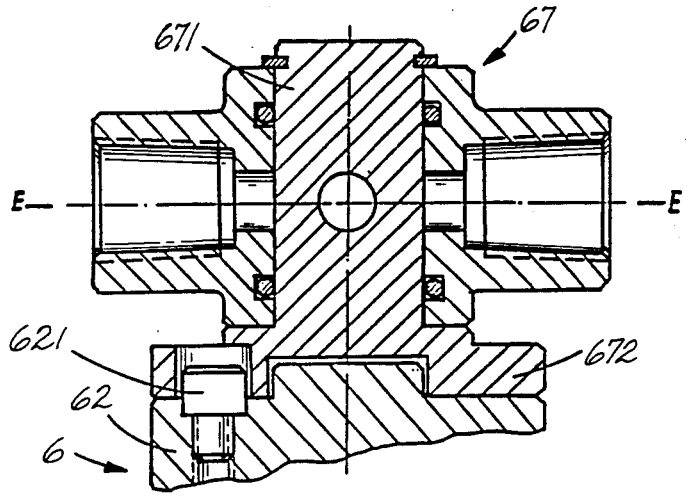
FIG. 11*a* is a schematic vertical section view of the cock.
Figure 11B:
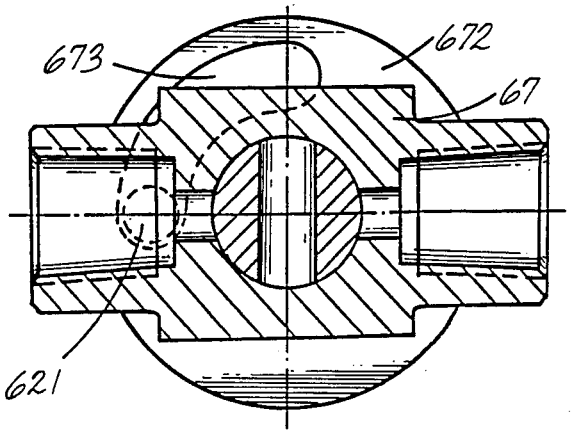
FIG. 11*b* is a section view along the line E—E in FIG. 11*a;*

The maximizing of break-apart torques and the limiting of make-up torques of torqueing fluid cylinder (5) are mainly accomplished through the effects of the cock (67) and shuttle valve (69). Cock (67) is controlled by the working direction reversing mechanism of torqueing fluid cylinder (5) and mounted on the top of suspension device (6) of the torqueing fluid cylinder. As seen in FIG. 11, a driving arm (621) is provided with upright axle (62) and used to turn valve plug (671) through driving plate (672) of cock (67) when the torqueing fluid cylinder being turned. And as seen in FIG. 10, during breaking apart, valve plug (671) of cock (67) is in the 'off' state, and pipe (d) and shuttle valve (69) are not fluid communicated. Still, as known from FIG. 10—the scheme of the fluid circuit, when time-delay valve (36) opens, the pressurized fluid flows into working chamber (51) of torqueing fluid cylinder (5) through pipe (a) and at the same time flows into working chamber (105) of assist fluid cylinder (10) through inner passage of the piston rod of assist fluid cylinder (10); restoring chamber (54) of torqueing fluid cylinder (5) and restoring chamber (104) of assist fluid cylinder (10) are fluid communicated with tank (36) through hose (B). Therefore, the force output of torqueing fluid cylinder (5) will equal to the product between the fluid pressure and the sum of piston (53) area of torqueing fluid cylinder (5) and the effective piston area of assist fluid cylinder (10). This force may produce the maximum torque, for example, up to 10000 Kfg.m or more for the breaking-apart operation of the power tongs.

As the torque-generating device turns 180 degrees horizontally for the implementation of the make-up procedure, see FIG. 11, driving arm (621) on upright axle (62) of fluid cylinder suspension device (6) drives valve plug (671) of cock (67) to turn 90 degrees to be in the on state (see FIG. 10) (Valve plug (671) is attached to driving plate (672) provided with a 90 degree idle stroke groove (673) so that valve plug (671) may always turn 90 degrees only, no matter when reversing torqueing fluid cylinder (5) from its break-apart position to its make-up position or doing the opposite). At this moment, the pressurized fluid from hose (A), firstly passing through pipe (d) and cock (67) and then opening shuttle valve (69), flows from pipe (s) into restoring chambers (54) and (104) of torqueing fluid cylinder (5) and assist fluid cylinder (10) to create a back pressure. When time-delay valve (36) opens, another stream of the pressurized fluid from hose (A) flows into working chambers (51) and (105) of torqueing fluid cylinder (5) and assist fluid cylinder (10) through pipe (a) underneath. So it can be seen that, since the fluid pressures in working chamber (105) and restoring chamber (104) of assist fluid cylinder (10) are equal, and the effective areas are equal too, assist fluid cylinder (10) is ineffective at this moment. And since the pressures in working chamber (51) and restoring chamber (54) of torqueing fluid cylinder (5) are also equal and the only effective area by which the pushing force can be delivered under the fluid pressure is the piston area smaller than the piston area of the torqueing fluid cylinder--for example, the piston rod area is 60%-70% of the piston area, the making up torques are consequently smaller—for example, the maximum torque output is about 4000-5000 Kfg.m. Thus, this makes making up torques have safe limitation to satisfy the required standard of the making up torques for the drill tools with normal sizes thus protecting joints of drill tools from damaging by the overtorqueing due to misoperation. The whole working process is completed automatically without any specially operated valves. So the present power tongs is very simple, convenient and practical. What needs to be explained further is: When it is needed in special cases (such as breaking apart left-hand threaded joints) that the power tongs provide larger make-up torques than that given by the above-mentioned limitation, the present invention may conveniently utilize the feature of 90 degree idle stroke groove (673) in driving plate (672) of cock (67) to turn valve plug (671) of cock (67) 90 degrees more manually, before workers operating the power tongs for making up (breaking apart the left-hand threaded drill tools), to have cock (67) closed again, that is, to have the torque limitation eliminated thus satisfying the large making up torque requirement in special cases After finishing making up or breaking apart operation, the valve spool of master control valve (37) is set to position II; hose (A) is connected with tank (38) and hose (B) supplies the pressurized fluid. At this moment, time-delay valve (36) is closed and torqueing fluid cylinder (5) and assist fluid cylinder (10) are restored.

By pushing handle (68) of hand-operated hydraulic lock (35) to release the lock—the check valve in hand-operated hydraulic lock (35) being pushed open, the fluid return passage of supercharger fluid cylinder (8) becomes opened and plunger (88) of supercharger fluid cylinder (8) gets restored. Along with the restoring of plunger (88) of supercharger fluid cylinder (8), the passage from hose (A) to working chambers (31) and (32) of gripping fluid cylinders (3) becomes unblocked. And thus gripping fluid cylinders (3) get restored under the pressure in restoring chambers (107) and (111). Two hand-operated hydraulic locks (35) can be separately or pairwise preset to release positions, that is, can be used optionally to control upper tong (1) or lower tong (2). If both hydraulic hand-operated locks (35) are preset to the release positions, all the execution machanisms of the power tongs will restore at the same time during the restoring operation of the power tongs. This optional control may satisfy various requirements raised by drilling technology. For example, it is very convenient to repeat making-up or breaking-apart many times, to break apart in combination with rotary tables or to restore after making up or breaking apart only once and to get the power tongs clear away.

Figures 12A, 12B:
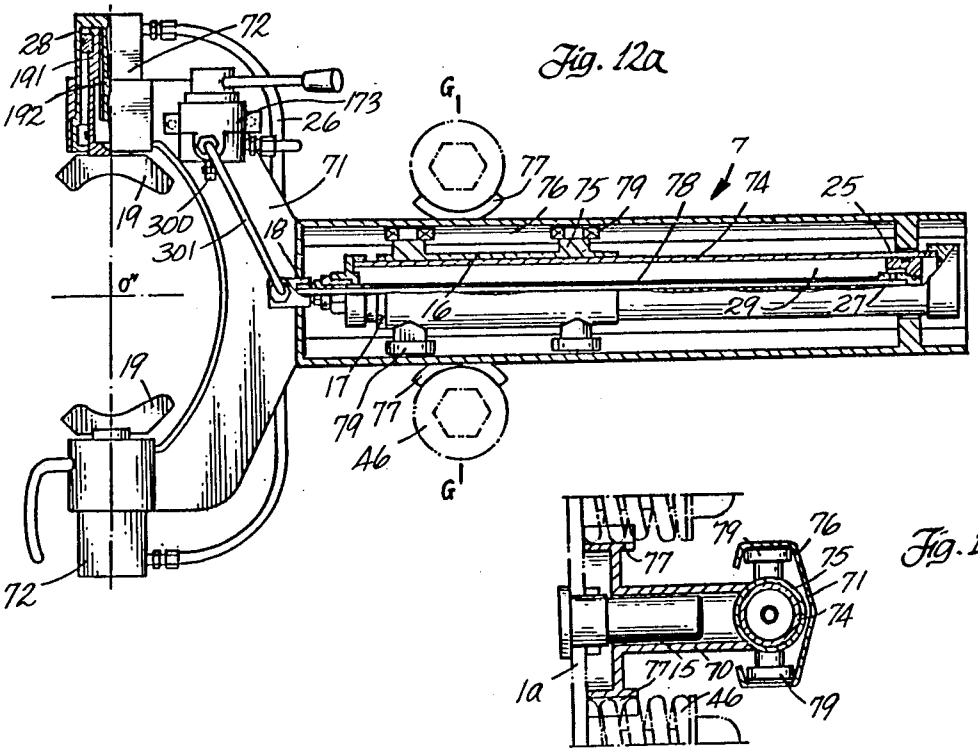
FIG. 12*a* is a schematic top plan view of the pull-in locating device.
FIG. 12*b* is a section view along the line G—G in FIG. 12*a;*

FIG. 12 illustrates the pull-in locating device (7) powered by compressed air. It includes a yoked ram (71), a pair of gripping jaw air cylinders (73) symmetrically mounted on both sides at the front of yoked ram (71), an air cylinder (74) is sleeved on upright rod (15) of upper tong body (1*a*) by means of pedestal (75) which is provided with a pair of supporting palms (77) on both sides. The concave-outward semi-cylindrical surfaces of palms (77) are against the profiles of two springs (46) of roller ram suspension device (4) so that there is certain flexibility in this kind of locating system. The cylinder body of hauling air cylinder (74) is slidably mounted in guide sleeve (16) of air cylinder pedestal (75) and fastened by check nut (17). Mounted on both sides of air cylinder pedestal (75) are four guiding rollers (79) with channeled guiding rails (76) riding on them; guiding rails (76) are formed open inward by bending the both sides of the slim longitudinal portion of the yoked ram stem. Therefore, yoked ram (71) can briskly slide on guiding rollers (79). Piston rod (78) of hauling air cylinder (74) is a hollow pipe only in tension and an air passage as well. Air inlet end (18) of piston (78) is attached to yoked ram (71) and connected with working chambers (28) of gripping jaw air cylinders (72). gripping jaws (19) and pistons (191) of gripping jaw air cylinders (72) are attached together to make a whole. Gripping jaws (19) and piston rods (191) are prevented from free rotation by sliding keys (192) in piston rods (191) to make gripping jaws (19) remain horizontal constantly. The orientation of the mouth of yoked ram (71) is in accordance with those of the mouthes of upper and lower tongs (1) and (2); when at the initial position, mouth centre (o'') of yoked ram (71) is on the extention of the connecting line between centres (o) and (o') of upper and lower tongs (1) and (2). Once the operators easily pull out yoked ram (71), that is, piston rod (78) of hauling air cylinder (74) to have the ram aligned with drill tools (see FIG. 1) and set air switch (73) on the working position (see FIG. 12), the compressed air, from inlet (300) through pipe (26), enters chambers (28) of gripping jaw air cylinders (72) to push piston rods (191) to have drill tools gripped by gripping jaws (19). At the same time, the compressed air, through pipe (301) and air passage (27) in piston rod (78), enters chamber (29) of hauling air cylinder (74). Under the action of the compressed air, piston (25) and piston rod (78), that is, yoked ram (71) retract. Since the pull-in locating device is mounted on upper tong (1) (see FIG. 1), once the gripping jaws get hold of drill tools, the power tongs freely suspended will be directionally pulled to drill tools and capable of self-centreing. The utilization of this device makes accurate positioning and easy operation.

The present invention is of the following advantages: When using the power tongs of the present invention for making up or breaking apart joints of drill tools of various sizes, no necessity for replacing any components or imposing additional operation thus making the operational work simple and convenient and the effectiveness enhanced; automatically limiting make-up torques to effectively avoid the damage of drill tools caused by the excessive torques during making up; simplicity of the configuration; automatically completing entire operation according to the predetermined procedures thus greatly reducing the operation time; less weight, low cost and reliable work.

We claim:

1. Power tongs for making up or breaking apart pipe joints having a longitudinal axis comprising:

an upper tong and a lower tong lying in spaced apart horizontal planes having on each tong body a pair of opposed gripping jaws disposed in facing relation and synchronously movable along a linear trace, respectively, for gripping engagement with upper and lower drill pipe joints, respectively;

means swivelly connecting and guiding said upper and lower tongs for relative angular movement about a vertical axis by an actuator;

a pressurized fluid powered multistage torque-generating unit with an assist fluid cylinder pivotally connected with said upper and lower tongs, respectively, said unit being able to output a torque to swivel said tongs in relation to each other over a limited displacement angle around the longitudinal axis of the pipe joints being gripped, whereby the drill pipe joint may be made up or broken apart, and being able to offer a bigger torque at the beginning of an unscrewing operation;

a supercharged gripping device disposed on each tong whereby said each pair of opposed gripping jaws may first move towards each other along a linear trace to grip pipes speedily and then by means of a supercharged fluid cylinder enlarge the gripping force to get hold of said pipes firmly without raising the pressure of fluid system, each said pair of gripping jaws may realize synchronous movement by means of a synchronizing mechanism;

a manual-pneumatic pull-in locating device mounted in parallel on said upper tong for aligning said upper and lower tongs with and pulling the over to said pipes; and a program controlling system enabling gripping operation and make-up or break-apart operation to be carried out according to a procedure predetermined.

2. The power tongs as defined in claim 1 wherein said means swivelly connecting and guiding said upper and lower tongs comprising an arc ram attached to said lower tong body, said ram having arc grooves thereon, a supporter mounted on the upper tong body by means of radially limited floating means and provided with at least three rollers being able to roll in an arc groove of said arc ram, thereby to swivelly connect said upper tong and said lower tong and to guide the relative angular movement.

3. The power tongs as defined in claim 2 wherein said means enabling the roller supporter to make limited floating radially are rubber rings placed between the axles of said rollers and the axle holes in said upper tong body.

4. The power tongs as defined in claim 1 wherein said multistage torquegenerating unit with an assist fluid cylinder comprises hydraulically controlled torquing cylinder, an assist fluid cylinder being capable of increasing torque output when required, a suspension frame and a torqueselecting device, either the chamber of said torqueing cylinder or the chamber of said assist fluid cylinder being divided into a rod chamber which is at the front of said chamber and a rod-less chamber which is at the rear of said chamber, the piston rod of said assist fluid cylinder having an axial fluid passage communicated with said rod-less chamber of said assist fluid cylinder, the free end of the piston rod of said torqueing cylinder being pivotally connected with the rear end of said lower tong through a ball bearing and the boyd of the torqueing cylinder being pivotally connected with the rear end of said upper tong through a suspension device, when upper and lower tongs being in coincident positions, the axes of said ball bearing and said suspension device coincide whereby enabling said torque-generating unit rotate around said coincided axes by about 180 degrees, said assist fluid cylinder being coaxially mounted on the end of said torqueing cylinder with the piston rod of said assist fluid cylinder being able to enter the rod-less chamber of said torqueing cylinder to contact with its free end the piston of the torqueing cylinder.

5. The power tongs as defined in claim 4 wherein the rod chambers of said torqueing cylinder and said assist fluid cylinder are always communicated with each other and so are their rod-less chambers, the fluid flowing into or out of said rod-less chamber of the assist fluid cylinder through said rod-less chamber of the torqueing cylinder, an opening at the free end of the piston rod of said assist fluid cylinder and the axial fluid passage in said piston rod.

6. The power tongs as defined in claim 4 wherein the front part of the outer surface of the body of said torqueing cylinder is provided with two radially symmetrical horizontal projecting lug pivots, said suspension frame having an upright axle with an eccentric driving key on one end face thereof and a pair of coaxial lug flanges, the axes of said upright axle and said lug flanges being orthogonal and apart from each other a certain distance which equals to that between the axle hole axis at the end of the piston rod and the lug pivot axis of the cylinder body when the piston rod of the torqueing cylinder completely retracts, said suspension frame being pivotally connected with said torqueing cylinder through said lug flanges, said upright axle of said suspension being pivotally mounted in said hole of the end of said upper tong.

7. the power tongs as defined in claim 1 wherein said program control system includes a time-delay valve which makes the time for the pressure fluid coming from the hydraulic source to enter said torque-generating unit slightly behind the time for the pressure fluid to enter the supecharged gripping device, said time of delay being adjustable.

8. The power tongs as defined in claim 7 wherein the adjustment of the time-of-delay of said time-delay valve is realized by adjusting the open degree of a throttling hole in said time-delay valve.

9. Power tongs for making up or breaking apart pipe joints having a longitudinal axis comprising:

an upper tong and lower tong lying in spaced apart horizontal planes having on each tong body a pair of opposed gripping jaws disposed in facing relation and synchronously movable along a linear trace, respectively, for gripping engagement with upper and lower drill pipe joints, respectively;

means swivelly connecting and guiding said upper and lower tongs for relative angular movement about a vertical axis by an actuator, said means including an arc ram with arc grooves thereon attached to said lower tong body and a supporter mounted floatably in radial direction on said upper tong and provided with at least three rollers being able to roll in an arc groove of said arc ram, thereby to swivelly connect said upper and lower tongs and to guide the relative angular movement;

a pressurized fluid powered multistage torque-generating unit with an assist fluid cylinder pivotally connected with said upper and lower tongs respectively, said unit being able to output a torque to swivel said tongs in relation to each other over a limited angle displacement around the longitudinal axis of the pipe joints being gripped, whereby the drill pipe joint may be made up or broken apart, and being able to offer a larger torque at the beginning of an unscrewing operation, when said upper and lower tongs are in coincident position, said unit being able to rotate about a vertical axis by 180 degrees, said unit comprising a torqueing fluid cylinder offering make-up torques, an assist fluid cylinder coaxially mounted with said torqueing cylinder for the requirement of increasing torque during breaking apart and a torque-selecting device, either the chamber of said torqueing cylinder or the chamber of said assist fluid cylinder being divided into rod chamber which is at the front of said chamber and rod-less chamber which is at the rear of said chamber, the piston rod of said assist fluid cylinder having an axial fluid passage communicated with said rod-less chamber of said assist fluid cylinder, the free end of the piston rod of said assist cylinder entering the rod-less chamber of said torqueing cylinder from the rear end of said torqueing cylinder to contact the the piston of said torqueing cylinder, the rod chambers of said torqueing cylinder and said assist fluid cylinder being mutually fluid communicated and so being their rod-less chambers, and fluid entering into and exiting from the rod-less chambers of said assist fluid cylinder through the rod-less chamber of said torqueing cylinder, an opening at the free end of the piston rod of said assist fluid cylinder and the axial fluid passage in the piston rod of said assist fluid cylinder, said piston rod of said torqueing cylinder being pivotally mounted in a bore-hole at the rear end of said lower tong by means of a ball bearing, said torqueing cylinder being swivelly connected with horizontal lug flanges on a suspension frame through horizontal lug pivots on both sides of said cylinder body, an upright axle on said suspension frame, orthogonal with and a certain distance apart from the axis of said horizontal lug flanges, being pivotally mounted in a bore-hole at the rear end of said lower tong, said upright axle having an eccentric crown key on upper end face thereof, said torque-selecting device consisting of a cock actuated by said eccentric crown key, said cock enabling said assist fluid cylinder to engage in or release from working state;

a supercharging gripping device disposed on each tong to enable each said pair of opposed gripping jaws first move towards each other along a linear trace to grip pipes speedily and then by means of a supercharged fluid cylinder to enlarge the gripping force to get hold of said pipes firmly without raising the pressure of fluid system, each said pair of opposed gripping jaws realizing synchronous movement by means of a synchronizing mechanism;

a manual-pneumatic pull-in locating device mounted in parallel on the upper tong for aligning said tongs with and pulling over them together to said pipes; and a program controlled system enabling gripping operation and making up or break-apart operation to be carried out automatically according to a procedure predetermined.

10. The power tongs as defined in claim 9 wherein said cock has a rotatable valve plug with a radial opening in its middle and a larger diameter dish-like flange at its outer end, said flange having an approximate 90 degree arc groove with one end aligning with said radial opening, said crown key on said upright axle of said suspension frame being movable in said arc groove, said valve plug being jacketed with a valve body in fluid-tight relation to the valve plug, said valve body including two radially opposed openings intersecting said radial opening of said valve plug.

11. Power tongs for making up or breaking apart pipe joints having a longitudinal axis comprising:

an upper tong and a lower tong lying in spaced apart horizontal planes having on each tong body a pair of opposed gripping jaws disposed in facing relation and synchronously movable along a linear trace, respectively, for gripping engagement with upper and lower drill pipe joints, respectively;

means swivelly connecting and guiding said upper and lower tongs for relative angular movement about a vertical axis by an actuator;

a pressurized fluid powered multi-stage torque-generating unit with an assist fluid cylinder pivotally connected with said tongs respectively, said unit being able to output a torque to swivel said tongs in relation to each other over a limited angle displacement around the longitudinal axis of the pipe joints being gripped to make up or break apart said pipe joints, and being able to offer a bigger torque at the beginning of an unscrewing operation;

a supercharged gripping device disposed on each tong whereby said each pair of opposed gripping jaws may first move towards each other along a linear trace to grip pipes speedily and then by means of a supercharged fluid cylinder enlarge the gripping force to get hold of said pipes firmly without raising the pressure of fluid system, each said pair of gripping jaws realizing synchronous movement by means of synchronizing mechanism;

a manual-pneumatic pull-in locating device mounted in parallel on said upper tong for aligning said tongs with and pulling them over to said pipes; and a program controlled system enabling gripping operation and make-up or break-apart operation to be carried out according to a procedure predetermined;

wherein said upper and lower tong bodies are similarly shaped and are substantially plate-like members each with a notch in the middle of its front side, said supercharged gripping device disposed on each tong includes a rapid pregripping and supercharging system consisting of two hydraulically powered gripping cylinders of identical configuration and a supercharger cylinder, an adaptive self-adjusting device of tong dies and tong dies release control device consisting of a hand operated hydraulic lock, said gripping cylinder has two entrance and exit fluid openings communicating with two chambers therein, two gripping cylinders are disposed coaxially and symmetrically on both sides of said notch of each of said tong bodies respectively, the cylinder housings of said two gripping cylinders being movable while the pistons and the piston rods thereof being unmovable, said movable cylinder housings are connected to said tong dies by means of said adaptive self-adjusting device of tong dies, a supercharger cylinder disposed at the back or other proper position of said tong body is connected with said two gripping cylinders through fluid pipes respectively, and said synchronizing mechanisms enabling synchronized extending or retracting movement of said tong dies.

12. The power tongs as defined in claim 11 wherein the piston of said gripping cylinder is attached to said tong body, each extendable and retractable cylinder body is connected through said adaptive self-adjusting device of tong dies and said entrance and exit fluid passages of two chambers of said fluid cylinder pass through the piston rod attached to said tong body.

13. The power tongs as defined in claim 11 wherein said supercharger cylinder includes a cylinder body attached to said tong body and piston assembly fluid-tightly movable in said cylinder body said cylinder body having a smaller diameter supercharging plunger chamber, a coaxial larger diameter chamber, a first fluid opening at one end of said plunger chamber, a second fluid opening in the middle of said plunger chamber, a third fluid opening in said plunger chamber and adjacent said larger diameter piston chamber, a fourth fluid opening in said piston chamber near the shoulder formed at the junction of the plunger and piston chambers and fifth fluid opening at the other end of said cylinder body, and said cylinder body including a plunger at the front end thereof fluid-tightly slidable in said plunger chamber, a piston in the middle portion thereof fluidtightly slidable in said piston chamber and a slender stroke-displaying rod at the rear thereof with its outer end constantly extending out from the packed hole at the back of the cylinder body, said plunger may close said second and third fluid openings one after another during the piston assembly is moving forward.

14. The power tongs as defined in claim 13 wherein said two fluid openings of a said gripping cylinder are connected with said fourth fluid opening of said supercharger cylinder and one of said first and second fluid openings through pipes respectively to make the fluid circuit of said gripping cylinder a differential circuit when the gripping cylinder extending out; two fluid openings of another said gripping cylinder are connected with said fourth fluid opening of said supercharger cylinder and another one of the first and second fluid openings of said supercharger cylinder through pipes respectively to form another differential circuit, said two differential circuits enabling said pair of gripping jaws of the gripping device to extending out rapidly.

15. The power tongs as defined in claim 11 wherein the adaptive self-adjusting device includes a piece of rubber cushion held between each gripping jaw and the outer end face of said gripping cylinder.

16. The power tongs as defined in claim 11 wherein said synchronizing mechanism includes two lengths of wire rope, one end of said one wire rope being fixed to one tong die and next around clockwise one pulley attached to said tong body and near the back of said gripping cylinder, and then another end being fixed to another said tong die, said another wire rope being in similar manner around counterclockwise another pulley symmetrically disposed in relation to said pulley and the two ends of the wire rope being fixed to said two tong dies respectively.

17. The power tongs as defined in claim 11 wherein said gripping jaw release controlling device is a hand operated hydraulic lock connected between the hydraulic source and said supercharger cylinder, when said hydraulic lock closes, the fluid in a chamber of said supercharger cylinder can not be discharged and the fluid return passage of said gripping cylinder is also closed up thus the tong dies being unable to retract so that said gripping jaws keep gripping the pipes, and when said hydraulic lock opens, the fluid in a chamber of the supercharger cylinder returns from said supercharger cylinder through said hydraulic lock in result to free the blockade to fluid return passage of said gripping cylinder thus making the tong die retracted to release said pipes.

18. The power tongs as defined in claim 17 wherein said hydraulic lock comprises a valve body including a fluid inlet and a fluid outlet and a valve poppet fited fluid-tightly in said valve body, and movable in its chamber, said valve poppet being biased by a compression spring on one end thereof to have a tendency of closing the fluid passage between said inlet and outlet therefore making said hydraulic lock function as a check valve, another end face of said valve poppet contacting the end face of an axially movable pushing rod controlled by a handle with an inclined face, when turning the handle, the pusing rod drives said valve poppet to move against the compression of said speing thus making the inner passage of the hydraulic lock two-way communicated.

19. The power tongs as defined in claim 18 wherein said valve poppet of said hydraulic lock has an axial hole for balancing the pressure in the chambers on both sides of the valve poppet.

20. Power tongs for making up or breaking apart pipe joints having a longitudinal axis comprising:

an upper tong and a lower tong lying in spaced apart horizontal planes having on each tong body a pair of opposed gripping jaws disposed in facing relation and synchronously movable along a linear trace, respectively, for gripping engagement with upper and lower drill pipe joints, respectively;

means swivelly connecting and guiding said upper and lower tongs for relative angular movement about a vertical axis by an actuator;

a pressurized fluid powered multi-stage torque-generating unit with an assist fluid cylinder pivotally connected with said upper and lower tongs respectively, said unit being able to output a torque to swivel said tongs in relation to each other over a limited displacement angle around the longitudinal axis of the pipe joints being stripped whereby the drill pipe joint may be make up or broken apart, and being able to offer a larger torque at the beginning of unscrewing operation;

a supercharged gripping device disposed on each tong whereby said each pair of opposed gripping jaws may first move towards each other along a linear trace to grip pipes speedily and then by means of a supercharged fluid cylinder enlarge the gripping force to get hold of said pipes firmly without raising the pressure of fluid system, each said pair of gripping jaws may realize synchronous movement by means of a synchronizing mechanism;

a manual-pneumatic pull-in locating device mounted in parallel said upper tong for aligning said upper and lower tongs with and pulling them over to said pipes;

a program controlled system enabling gripping operation and make-up or break-apart operation to be carried out according to a procedure predetermined;

wherein said manual-pneumatic pull-in locating device includes a back and forth movable ram body provided with horizontal pneumatically powered gripping jaws at the front and having longitudinal guiding rails, a hauling air cylinder being mounted on said upper tong with guiding rollers on both sides, one end of the piston rod of said air cylinder being connected with said ram body, said ram body can slide on said guiding rollers by means of its guiding rails, the centre of said pneumatically powered gripping jaws is aligned with the centres of said two pairs of gripping jaws of said upper and lower tongs as said ram body fully retracted.

21. The power tongs as defined in claim 20 wherein said ram is substantially a yoked member, symmetrically mounted respectively on its both sides being gripping jaws powered directly by air cylinders and movable back and forth transversely, fixed to its being an air switch and on body sides of its slender longitudinal portion being formed into two parallel, open inward and channel;-sectioned longitudinal guiding rails containing said guiding rollers.

22. The power tongs as defined in claim 20 wherein said hauling air cylinder is a monodirectional air powered cylinder, the middle of the cylinder body being movably mounted on said upper tong body and being flexible in the horizontal plane.

* * * * *

UNITED STATES PATENT AND TRADEMARK OFFICE

CERTIFICATE OF CORRECTION

PATENT NO. : 4,727,781

DATED : March 1, 1988

INVENTOR(S) : Chen Yuehui and Gao Kun

It is certified that error appears in the above-identified patent and that said Letters Patent is hereby corrected as shown below:

On the Front Page

In the Abstract, line 5, change "torqueing" to -- torquing --.

In the Specification

Column 1, line 64, before "being" insert -- is --.

Column 1, line 66, change "machanism" to -- mechanism --.

Column 2, lines 32, 34, 39, change "torqueing" to -- torquing --.

Column 3, lines 16, 29, change "torqueing" to -- torquing --.

Column 3, line 40, change "peneumatically" to -- pneumatically --.

Column 3, line 44, Change "pressureresistent" to -- pressure resistent --.

Column 3, line 45, change "supecharged" to -- supercharged --.

Column 3, line 65, change "kg.fm" to -- Kgf·m --.

Column 4, line 29, change "prgripping" to -- pregripping --.

UNITED STATES PATENT AND TRADEMARK OFFICE

CERTIFICATE OF CORRECTION

PATENT NO. : 4,727,781

DATED : March 1, 1988

INVENTOR(S) : Chen Yuehui and Gao Kun

It is certified that error appears in the above-identified patent and that said Letters Patent is hereby corrected as shown below:

Column 4, line 49, change "lost" to -- lose --.

Column 4, line 53, change "machanism" to -- mechanism --.

Column 5, line 6, delete "air" and insert therefor -- aim --.

Column 5, line 18, after "tong" insert -- . --.

Column 5, line 66, change "appart" to -- apart --.

Column 6, line 2, after "to" and before "above" insert -- the --.

Column 6, lines 4, 8, 14, 15, 17, 19, 27, 34, 38, 39, 43, 45, 48, 50, 62, 65, 68, change "torqueing" to -- torquing --.

Column 6, line 5, change "that" to -- that's --.

Column 6, line 6, after "connected" insert a period.

Column 6, line 14, after "against" delete "piston" (second occurence).

Column 6, line 37, change "reversable" to -- reversible --.

Column 6, line 61, change "coaxility" to -- coaxially --.

Column 7, lines 1, 5, change "torqueing" to -- torquing --.

UNITED STATES PATENT AND TRADEMARK OFFICE

CERTIFICATE OF CORRECTION

PATENT NO. : 4,727,781

DATED : March 1, 1988

INVENTOR(S) : Chen Yuehui and Gao Kun

It is certified that error appears in the above-identified patent and that said Letters Patent is hereby corrected as shown below:

Column 7, line 10, change "breakapart" to -- break-apart --.

Column 7, line 24, change "352" to -- (352) --.

Column 7, line 35, change the colon to a period.

Column 7, lines 51, 52, 53, change "torqueing" to -- torquing --.

Column 7, line 63, change "holse" to -- hose --

Column 8, line 7, change "pre-grippig" to -- pregripping --.

Column 8, line 10, change "pre-gripping" to -- pregripping --.

Column 8, line 14, change the colon to a period.

Column 8, lines 37, 40, 43, 45, 52, 56, 59, 61, change"torqueing" to -- torquing --.

Column 8, line 48, change " 'off' " to -- "off" --.

Column 8, line 59, after "will" insert -- be --.

Column 8, line 64, change "Kfg.m" to -- Kgf·m --.

UNITED STATES PATENT AND TRADEMARK OFFICE

CERTIFICATE OF CORRECTION

PATENT NO. : 4,727,781

DATED : March 1, 1988

INVENTOR(S) : Chen Yuehui and Gao Kun

It is certified that error appears in the above-identified patent and that said Letters Patent is hereby corrected as shown below:

Column 9, line 3, after "(see FIG. 10)" and before "(Valve plug (671)" insert -- . --.

Column 9, line 8, change "opposite)" to -- opposite --.

Column 9, Lines 6, 12, 16, 23, 27, 56, change "torqueing" to -- torquing --.

Column 9, line 35, change "overtorqueing" to -- over torquing --.

Column 9, line 31, change "Kfg.m" to -- Kgf·m --.

Column 9, line 51, after "cases" insert a period.

Column 9, line 66, after "unblocked" insert -- , that is, the fuid return passage to tank (38) becomes unblocked --.

Column 10, line 5, change "machanisms" to -- mechanisms --.

Column 10, line 37, at the beginning of the sentence change "gripping" to -- Gripping --.

Column 10, line 44, change "mouthes" to -- mouths --.

Column 10, line 67, after "invention" delete "is of" and insert therefor -- has --; after "advantages" delete the colon and insert a period.

UNITED STATES PATENT AND TRADEMARK OFFICE

CERTIFICATE OF CORRECTION

PATENT NO. : 4,727,781

DATED : March 1, 1988

INVENTOR(S) : Chen Yuehui and Gao Kun

It is certified that error appears in the above-identified patent and that said Letters Patent is hereby corrected as shown below:

In the Claims

Column 11, line 47, after "pulling the" insert -- device --.

Column 11, line 68, change "torquegenerating" to -- torque generating --.

Column 12, line 4, change 'torqueselecting" to -- torque-selecting --.

Column 12, Lines 5, 12, 14, 21, 23, 25, 27, 31, 37, 47, 48, change "torqueing"to -- torquing --.

Column 12, Lines 7, 10, 23, 29, 30, 31, change "rod-less" to -- rodless --.

Column 12, line 14, change "boyd" to -- body --.

Column 12, line 51, at the beginning of the sentence change and before "power" change "the" to -- The --.

Column 12, line 57, change "supecharged" to -- supercharged --.

Column 13, Lines 25, 27, 30, 39, 40, 41, 42, 47, 50, 52, change "torqueing" to -- torquing --.

Column 13, lines 32, 36, 38, 44, 45, 46, change "rod-less" to -- rodless --.

UNITED STATES PATENT AND TRADEMARK OFFICE

CERTIFICATE OF CORRECTION

PATENT NO. : 4,727,781

DATED : March 1, 1988

INVENTOR(S) : Chen Yuehui and Gao Kun

It is certified that error appears in the above-identified patent and that said Letters Patent is hereby corrected as shown below:

Column 13, line 40, after "contact" delete "the" (second occurence).

Column 13, lines 51, 59, change "bore-hole" to -- borehole --.

Column 13, line 68, after "jaws" delete "first" and insert therefor -- to --.

Column 14, line 10, after "pulling" delete "over them together" and insert therefor -- them together over --.

Column 14, line 68, after "tong" delete "includes" and insert therefor -- including --.

Column 15, line 46, change "fluidtightly" to -- fluid tightly --.

Column 15, line 51, after "another" delete "during" and insert therefor -- as --.

Column 15, line 65, change "extending" to -- extend --.

Column 16, line 25, after "lock" delete "in result".

Column 16, line 31, change "fited" to -- fitted --.

Column 16, line 32, change "fluid-tightly" to -- fluid tightly --.

UNITED STATES PATENT AND TRADEMARK OFFICE

CERTIFICATE OF CORRECTION

PATENT NO. : 4,727,781

DATED : March 1, 1988

INVENTOR(S) : Chen Yuehui and Gao Kun

It is certified that error appears in the above-identified patent and that said Letters Patent is hereby corrected as shown below:

Column 16, line 41, change "speing" to -- spring --.

Column 16, line 66, after "be" change "make" to -- made --.

Column 18, line 14, before "sides" delete "body" and insert therefor -- both --.

Column 18, line 16, change "channel;-sectioned" to -- channel-sectioned --.

Signed and Sealed this

Tenth Day of January, 1989

*Attest:*

*Attesting Officer*

DONALD J. QUIGG

*Commissioner of Patents and Trademarks*